United States Patent [19]

Colglazier et al.

[11] 4,456,235

[45] Jun. 26, 1984

[54] BOTTOM-UP STACKER

[75] Inventors: Donald F. Colglazier; Ernest P. Kollar, both of Longmont, Colo.

[73] Assignee: International Business Machines Corporation, Armonk, N.Y.

[21] Appl. No.: 56,170

[22] Filed: Jul. 9, 1979

[51] Int. Cl.[3] ..... B65H 1/30; B65H 29/24; B65H 31/12

[52] U.S. Cl. ..... 271/3.1; 271/212; 271/236; 271/251; 271/177; 271/194; 414/37; 414/95

[58] Field of Search ..... 271/212, 3.1, 3, 4, 271/194, 236, 251, 177, 180, 181; 355/3 SH, 14 SH; 414/37, 93, 95, 96, 92

[56] References Cited

U.S. PATENT DOCUMENTS

| | | | |
|---|---|---|---|
| 3,010,717 | 11/1961 | Zabriskie et al. | 271/212 |
| 3,396,966 | 8/1968 | Solheim | 271/212 |
| 3,412,915 | 11/1968 | Hertrich | 271/194 X |
| 3,556,513 | 1/1971 | Howard | 271/4 |
| 3,685,671 | 8/1972 | Layman | 414/93 |
| 3,702,697 | 11/1972 | Leutwein et al. | 271/3 |
| 3,934,869 | 1/1976 | Strobel | 271/35 |
| 3,947,018 | 3/1976 | Stange | 271/99 |
| 3,971,554 | 7/1976 | Stange | 271/212 X |
| 4,014,537 | 3/1977 | Stange | 271/166 |
| 4,017,066 | 4/1977 | Lasher et al. | 271/251 X |

*Primary Examiner*—George E. A. Halvosa
*Assistant Examiner*—James E. Barlow
*Attorney, Agent, or Firm*—Joscelyn G. Cockburn; Earl C. Hancock; Francis A. Sirr

[57] ABSTRACT

Documents are inserted into a bin beneath a document stack already in the bin. An air bearing holds the document stack above the floor of the bin. A lifting mechanism lifts the stack along one edge so that a document is driven between the last sheet in the stack and the floor of the bin. A selectively activated drive means positioned on the floor of the bin advances the document into proper registration into the bin. Documents can be fed from the top of the stack simultaneously with the bottom stacking operation.

22 Claims, 19 Drawing Figures

FIG. 15A

```
                                LISTP BUSTK

INST|OP|OPER-|STMT|
LOCN|CD|AND  | NO |LABEL |OP |T|*OPERAND |  COMMENT
-----------------------------------------------------------------------
                    1 BUSTK  ORG   H1900     THIS PROGRAM CONTROLS
                    2 *                      THE BOTTOM UP STACKER
                    3 *
                    4 *
1900 A9 5F          5        LDA I H5F       DISPLAY MESSAGE ON
1902 85 01          6        STA 0  1        ROBOT GAS PANEL
1904 A2 00          7        LDX I  0         BOTTOM UP STACKER'
1906 8A             8        TXA
1907 20 00 18       9        JSR A  DISP
                   10 *
                   11 *
190A F8            12        SED             INITIALIZE HARDWARE
190B A9 40         13        LDA I H40       CONTROLS
190D 8D 1B 08      14        STA A H081B      (T-1 FREE RUN)
1910 A9 C0         15        LDA I HC0
1912 8D 1E 08      16        STA A H081E      (T-1 INTR ENABLE)
                   17 *
1915 A0 30         18        LDY I H30       INITIALIZE REGISTERS
1917 84 04         19        STY 0  4         AND COUNTERS
1919 84 05         20        STY 0  5
191B 84 06         21        STY 0  6
191D 84 07         22        STY 0  7
191F 85 21         23        STA 0  NIPCNT
1921 A9 80         24        LDA I H80
1923 85 08         25        STA 0  8
1925 A9 00         26        LDA I H00
1927 85 20         27        STA 0  FLAG
                   28 *
1929 A9 04         29        LDA I  4        START 1MS INTERRUPTS
192B 8D 15 08      30        STA A H0815     (T-1 TIMER)
192E A9 0F         31        LDA I H0F
1930 8D 13 08      32        STA A H0813
1933 8D 11 08      33        STA A H0811
                   34 *
1936 2C 11 08      35 B1     BIT A H0811     PAPER TRAY SENSOR ON
1939 10 FB         36        BPL    B1       FOR AT LEAST 100MS?
193B A0 0A         37        LDY I  10
193D 86 02         38 B10    STX 0  2
193F 86 03         39        STX 0  3
1941 A5 03         40 B8     LDA 0  3
1943 C9 01         41        CMP I  1
```

FIG. 15B

```
1945 D0 FA      42          BNE    B8
1947 2C 11 08   43          BIT A H0811
194A 10 EA      44          →PL    B1
194C 88         45          DEY
194D D0 EE      46          BNE    B10
194F A5 02      47 B2       LDA 0  2
1951 C9 01      48          CMP I  1
1953 D0 FA      49          →≠0    B2
                50 *
1955 A9 0C      51          LDA I H0C        TURN ON VAC SOLENOID
1957 8D 11 08   52          STA A H0811      AND DRIVE MOTOR
                53 *
195A 2C 11 08   54 B3       BIT A H0811
195D 30 FB      55          BMI    B3        PAPER GONE ?
195F 86 02      56          STX 0  2
1961 86 03      57          STX 0  3
1963 A5 03      58 B4       LDA 0  3
1965 C9 10      59          CMP I H10
1967 D0 FA      60          BNE    B4
1969 2C 11 08   61          BIT A H0811
196C 30 EC      62          BMI    B3        PAPER STILL GONE ?
                63 *
196E A9 02      64          LDA I  2         TURN OFF DRIVE MOTOR
1970 8D 11 08   65          STA A H0811      TURN ON VANE AND LIFT
1973 A5 02      66 B5       LDA 0  2         SOLENOID
1975 C9 01      67          CMP I  1
1977 D0 FA      68          BNE    B5        DELAY 100 MS
                69 *
1979 A5 02      70 B6       LDA 0  2         TURN OFF VANE SOLENOID
197B A9 06      71          LDA I  6
197D 8D 11 08   72          STA A H0811
                73 *
1980 A5 02      74 B7       LDA 0  2
1982 C9 02      75          CMP I  2
1984 D0 FA      76          BNE    B7        DELAY 100 MS
                77 *
1986 A9 0F      78          LDA I H0F        TURN OFF VACUUM
1988 8D 11 08   79          STA A H0811      AND LIFT SOLENOID
                80 *
198B 20 C0 18   81          JSR A  COUNT     COUNT # OF COPIES
                82 *
198E A9 00      83          LDA I H00        REQUEST ANOTHER PICK
1990 85 20      84          STA 0  FLAG
                85 *
1992 4C 36 19   86          JMP A  B1
                87          END
```

FIG. 16

```
                                LST'HALT'

                     1 HALT   ORG    H1A00      HALT FEEDER
                     2 *
1A00 A9 40           3        LDA I H40         RAISE SHINGLER
1A02 8D 10 08        4        STA A H0810
                     5 *
1A05 A9 00           6        LDA I H00         RESET FLAG
1A07 85 20           7        STA 0  FLAG
                     8 *
1A09 A9 30           9        LDA I H30         RESET NIP COUNT
1A0B 85 21          10        STA 0  NIPCNT
1A0D 60             11        RTS
                    12        END
```

FIG. 17

```
                          LISTP'COUNT'

INST|OP|OPER-|STMT|
LOCN|CD|AND  | NO |LABEL |OP |T|*OPERAND |  COMMENT
---- -- ----- ---- ------ --- - ----------------------------------

                     1 COUNT  ORG    H18C0      COUNT NUMBER OF COPIES
                     2 *
18C0 A0 30           3        LDY I H30
18C2 A9 3A           4        LDA I H3A
18C4 E6 07           5        INC 0  7          INCREMENT COPY COUNT
18C6 C5 07           6        CMP 0  7          REGISTERS
18C8 D0 13           7        BNE    C1
18CA 84 07           8        STY 0  7
18CC E6 06           9        INC 0  6
18CE C5 06          10        CMP 0  6
18D0 D0 0B          11        BNE    C1
18D2 84 06          12        STY 0  6
18D4 E6 05          13        INC 0  5
18D6 C5 05          14        CMP 0  5
18D8 D0 03          15        BNE    C1
18DA E6 04          16        INC 0  4
                    17 *
18DC 78             18        SEI               DISABLE INTERRUPTS
18DD 86 01          19 C1     STX 0  1          DISPLAY COUNT ON
18DF A9 04          20        LDA I  4          GAS PANEL
18E1 20 00 18       21        JSR A  DISP
18E4 A9 1F          22        LDA I H1F
18E6 85 01          23        STA 0  1
18E8 A9 1D          24        LDA I H1D
18EA 20 00 18       25        JSR A  DISP
                    26 *
18ED 58             27 C2     CLI               ENABLE INTERRUPTS
18EE 60             28        RTS
                    29        END
```

FIG. 18

```
INST|OP|OPER-|STMT|
LOCN|CD|AND  | NO |LABEL |OP  |T|*OPERAND |  COMMENT
---- -- ----- ---- ------ --- - ----------------------------------
                 1 TIMER  ORG   H1843      INTERRUPT SERVICE SUB
                 2 *                       (TEST FOR PICK SHEET)
                 3 *
1843 48          4        PHA
                 5 *
1844 A5 03       6        LDA 0 H03        INCREMENT TIME REG'S
1846 18          7        CLC
1847 69 01       8        ADC I H01
1849 85 03       9        STA 0 H03
184B 90 06      10        BCC    T1
184D A5 02      11        LDA 0 H02
184F 69 00      12        ADC I H00
1851 85 02      13        STA 0 H02
1853 AD 14 08   14 T1     LDA A H0814      RESET INTERRUPT
                15 *
1856 AD 11 08   16 T5     LDA A H0811      TEST FOR START
1859 0A         17        ASL              SWITCH OFF
185A 10 06      18        BPL    T9
185C 20 00 1A   19        JSR A  HALT
185F 4C 87 18   20        JMP A  T6
                21 *
1862 29 40      22 T9     AND I H40        TEST THAT NIP SWITCH
1864 F0 0C      23        BEQ    T2        IS ON FOR AT LEAST
1866 C6 21      24        DEC 0  NIPCNT    48 MS
1868 D0 1C      25        BNE    T3
                26 *
186A AD 10 08   27 T4     LDA A H0810      STOP SHINGLER MOTOR
186D 09 40      28        ORA I H40
186F 8D 10 08   29        STA A H0810
                30 *
1872 A9 30      31 T2     LDA I H30        RESET NIP SW DEBOUNCE
1874 85 21      32        STA 0  NIPCNT
1876 A5 20      33        LDA 0  FLAG      TEST FOR FLAG CLEAR
1878 D0 0C      34        BNE    T3
187A A9 01      35        LDA I H01        SET FLAG
187C 85 20      36        STA 0  FLAG
                37 *
187E AD 10 08   38 T7     LDA A H0810      START SHINGLER MOTOR
1881 29 3F      39        AND I H3F
1883 8D 10 08   40        STA A H0810
                41 *
1886 EA         42 T3     NOP
1887 68         43 T6     PLA
1888 40         44        RTI
                45        END
```

BOTTOM-UP STACKER

BACKGROUND OF THE INVENTION

1. Field of the Invention

The present invention relates in general to apparatus for feeding sheets of paper or the like sequentially from a stack. More particularly, the present invention relates to an improved apparatus wherein sheets of paper are fed from the top of a stack of sheets and stack at the bottom of the stack.

2. Prior Art

Many different types of sheet feeding machines are available in the prior art. The sheet feeding machines are generally used in combination with electrophotographic copying machines, printing machines, multigraph machines, collators, etc.

In one type of prior art sheet feeding machines, sheets are fed from the bottom of a stack while sheet stacking (i.e, the addition of sheets) occurs on top. This type of sheet stacking machine is generically called "Top Stacking, Bottom Feeding" sheet feeding machines.

U.S. Pat. No. 3,385,593 is representative of the top stacking bottom feed prior art sheet feeding machines. In this type of sheet feeding machine a stack of sheets is supported by a support mechanism having an opening in its bottom surface to expose a portion of the bottom sheet in the stack. The end of the stack adjoining the opening is further supported by a bracket member. The support mechanism is fitted with pneumatic means which help to support the sheets in the support mechanism. A reciprocable motion-transmitting member is mounted directly beneath the support mechanism. The reciprocating motion occurs in a horizontal plane which runs parallel to the bottom surface of the support mechanism. The reciprocable motion transmitting member is also activated upwardly and downwardly with respect to the plane of reciprocable motion. All motions, be it reciprocable, upward or downward, are generated from a rotatable cam roller motor assembly. A vacuum assisted picker member is mounted on the reciprocable motion-transmitting member. The picker member is positioned to be in alignment with the opening in the support mechanism.

In operation, the picker member under the control of the rotatable cam-roller motor assembly moves into contact with the bottom sheet in the stack. The picker member moves backward, so as to release the sheet from the bracket member, downward and then forward to deliver the sheet. A more detailed description of this type of prior art sheet feeding machine is given in the above referenced U.S. Patent.

U.S. Pat. No. Re. 27,976 is another example of prior art bottom feed top stacking prior art sheet feeding machine. In the patent, sheets are fed sequentially from a sheet support bin or tray. The tray consists of a bottom wall with a plurality of continguous side walls. A rotatable drive roller protrudes through a hole in the bottom wall to drive a sheet through an opening in one of the side walls. In order to maintain pressure on the stack of sheets positioned in the tray an adjustable spring loaded weight is positioned to move relative to the bottom wall of said tray.

In another type of prior art sheet feeding device a sheet is fed from the top of a stack of sheets while sheets are added to the stack from the top. Generically, this type of prior art sheet feeding device can be classified as the Top Stacking Top Feeding. In this type of sheet feeding device by necessity the stacking and feeding functions occur sequentially.

When the above described prior art sheet feeding machines are adopted for use as a recirculating document feed, particularly in conjunction with an electrophotographic machine at least two of the above described units are needed. A particular configuration showing the use of the bottom feed top stacking unit as a recirculating document feed is shown in the above described U.S. Pat. No. Re. 27,976. In the configuration the document glass of the electrophotographic machine is positioned between a pair of the above described bottom feed top stacking units. The bottom feed top stacking units are integrally formed with the electrophotographic machine. As such there is a lack of modularity between the units and the electrophotographic machine. The lack of modularity is an undesirable result.

Another drawback with the above configuration is that it is relatively expensive and cumbersome due to the fact that two units are needed for the recirculating document feed. One of the units is needed to deliver a sheet on the document glass and another unit is needed to accept the sheet after processing. Even where the unit is not used in the environment of a recirculating document feed but is used as a sequential paper feed device, one unit cannot be used as a stacker and feeder simultaneously. As such there are several limitations in the prior art sheet feeding units which the present invention will alleviate.

Another problem which is associated with top stacking paper feed devices is that these devices have relatively low reliability. The low reliability stems from the fact that the stacking occurs on a pile or stack whose height changes periodically. This requires either a stacking mechanism which adjusts its throw on the stack, as the height of the stack changes, or a constant throw stacker which throws at a height to clear the top of the stack. Either way precise control of the stacking mechanism is necessary to assure proper operation. The control means which is needed to maintain precise control over the stacking mechanism tends to increase the complexity of the device and hence a reduction in its reliability.

SUMMARY OF THE INVENTION

It is, therefore, the object of the present invention to provide a more reliable and efficient sheet feeding device that has heretofore been possible.

It is another object of the present invention to provide a sheet feeding apparatus wherein sheet feeding and sheet stacking is achieved singly or simultaneously using a single sheet support tray.

It is a further object of the present invention to provide a modular sheet feeding device suitable for universal attachment to other types of machines (e.g., printers, electrophotographic machines, etc.)

It is still a further object of the present invention to provide a more reliable, efficient and low cost recirculating document feed than was hereto possible.

The above drawbacks in the prior art sheet feeding devices are overcome and the above objects are achieved by the present invention in which documents are stacked from the bottom using an air bearing means to create a space between a last document, on a stack, and the bottom of a document support tray. A document to be added to the stack is then inserted in the space.

More particularly, the sheet feeding device comprises a sheet support bin with a bottom surface being an air bearing and an entrance through which a sheet is propelled into the bin. A support means is positioned at the entrance of the bin. The support means cooperates with the air bearing to elevate a sheet or sheets above the bottom surface while a sheet feeding means associated with the bin ejects a sheet between the air bearing and the elevated sheet or sheets.

In one feature of the invention the sheet feeding means includes a first set of drive rollers having a frictional drive roller cooperating with a hard back-up roller to define a nip through which the sheet is transported. A second drive roller is seated in the bottom of the tray and propells the sheet to a final position in the tray. Friction between the sheet and the second drive roller is achieved by a source of negative pressure positioned relative to said second drive roller.

In another feature of the invention the sheet support bin includes a pair of sides integrally molded to the bottom. One of the sides is arranged opposite to the entrance of the bin and operates as a back stop for sheets in said bins. The other side is used for registration.

In still another feature of the invention the second drive roller is positioned at an offset angle with respect to the registration side of said support bin. The arrangement allows an incoming sheet to be driven against the registration side thereby allowing proper alignment with sheets already in the bin.

When used as a recirculating document feed, a stack of documents is placed within the tray. A feed means is provided relative to the stack and is controlled to feed documents serially from the top of said stack. The document is transported to the exposure platen of an electrophotographic copier for copying. After copying, the document is fed to the bottom of the stack. Documents are, simultaneously, fed from the top of the stack and inserted at the bottom of said stack to enhance system throughput.

The foregoing and other objects, features and advantages of the invention will be apparent from the following more particular description of the preferred embodiment of the invention, as illustrated in the accompanying drawings.

BRIEF DESCRIPTION OF THE DRAWINGS

FIGS. 15A, 15B, 16, 17 and 18 show the listing of a program which controls the paper feed device.

DESCRIPTION OF THE PREFERED EMBODIMENT

Figure 1:
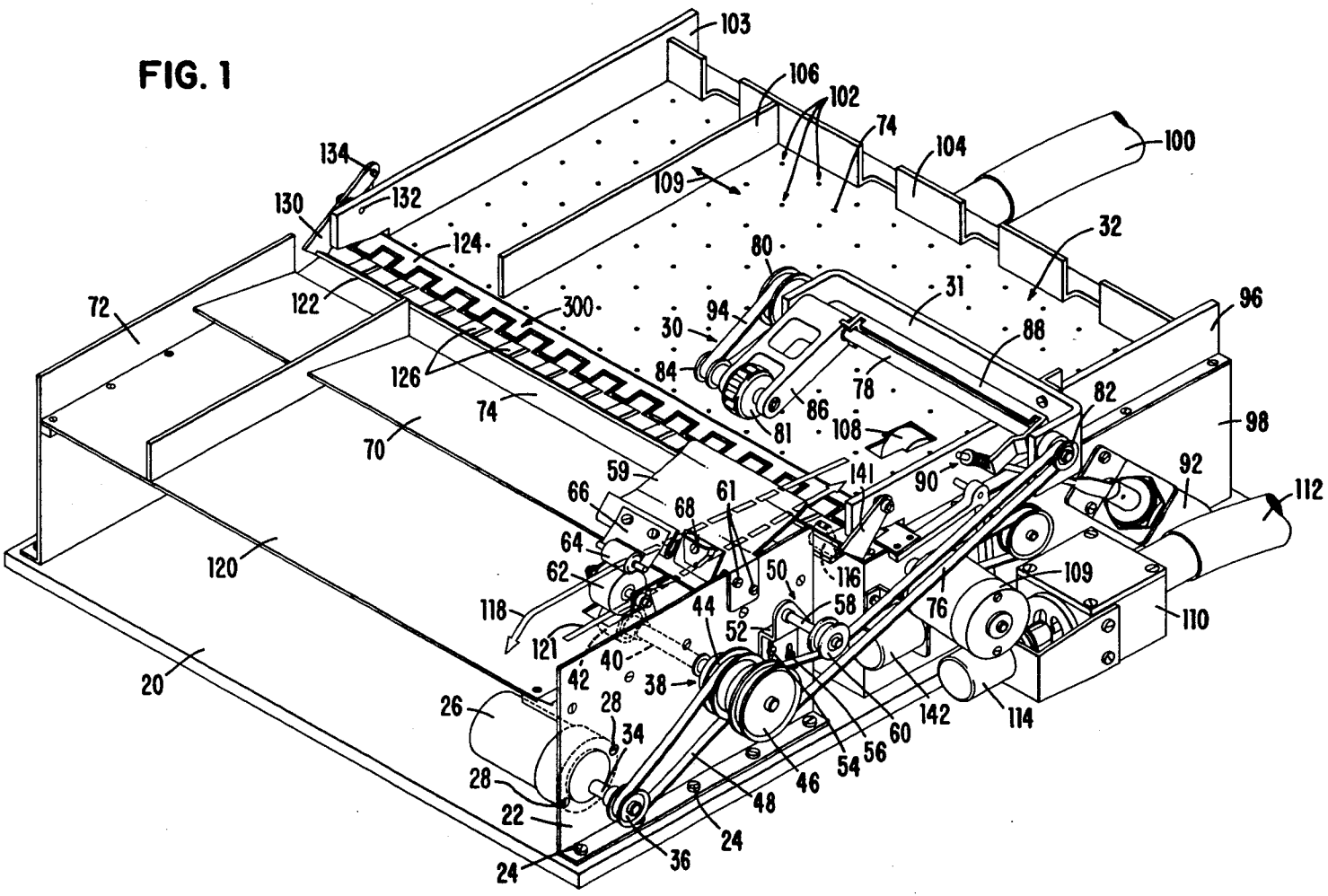
FIG. 1 shows a pictorial view of a paper feed device constructed in accordance with the teaching of the present invention.

Referring now to FIG. 1, a pictorial view of the sheet feeding device is shown. The sheet feeding device is a stand alone module which may be attached to an electrophotographic copying device or the like to feed paper thereto. The apparatus includes the base 20 which forms the support structure for the document feed apparatus. A side support plate 22 is mounted to the base 20 by a plurality of fastening means such as screws 24. A drive motor 26, is mounted to side support plate 22 by screws 28. As will be explained subsequently, the drive motor 26, when activated, drives the picker assembly 30 which picks the topmost sheet from a stack of sheets (not shown) seated in the support tray 32 and feeds a sheet, not shown, into support tray 32 at the bottom of the stack. The motor 26 is fitted with the shaft 34 extended through the side support plate 22 with a pulley 36 mounted thereon. A motion transmitting means 38 is mounted onto the side support plate 22. The motion transport means 38 includes a rotating shaft 40. A drive roller 42 is mounted to one end of shaft 40 while a pair of drive pulleys 44 and 46, respectively, are attached to the other end of shaft 40. A drive belt 48 interconnects drive pulley 36 and drive pulley 44, respectively. Likewise, a drive belt 76 interconnects drive pulleys 46 and 82, respectively. A tensioning means 50 is mounted to the side support plate 22. The tensioning means 50 includes an adjustable plate 52. A pair of elongated slots are formed in the adjustable plate while mounting screws 54 and 56 attach the adjustable plate through the elongated slots onto mounting plate 22. The shaft 58 is fixedly mounted to the adjustable plate and a pulley 60 is attached to the free end. By loosening the screw and moving the tensioning means along the elongated slots so that pulley 60 is in contact with drive belt 76 the tension in said belt can be adjusted.

Still referring to FIG. 1, upper guide channel 59 is mounted to side support plate 22 by screws 61. The primary function of the upper guide channel is to guide a sheet of paper (not shown) as it exits from support tray 32 into the nip of feed rollers 62 and 64, respectively, along output paper path 118. Guide roller 64 is connected to upper guide channel 59 by support bracket 66. Nip sensor means 68 is also supported by upper guide channel 59. As will be explained subsequently, the nip sensor which includes a light emitting and light receiving means such as an LED and a phototransistor senses when a sheet of paper is outputted from tray 32 and generates a control signal which is used to control the rate at which paper is fed from a stack (not shown) by picker assembly 30. Lower guide channel 70 is a rectangular member which runs the width of the support tray 32. One end of lower guide channel 70 is attached to side support plate 22 while the other end is attached to second side support plate 72. The lower guide channel 70 is inclined relative to the bottom 74 of support tray 32. As a sheet (not shown) is fed from the support tray, it is guided into feed rollers 62 and 64, respectively, by the lower guide channel 70 and the upper guide channel 59. The motive force for driving the shet is supplied to drive roller 42 by the drive motor 26.

The rotary motion from drive motor 26 is transmitted to the picker assembly 30 by drive belt 76. As a result, the picker assembly 30 picks the topmost sheet from a stack of paper, not shown, seated in support tray 32. The picker assembly 30 includes drive shaft 78. On one end of the drive shaft a pulley 80 is mounted. Pulley 82 is mounted on the other end of the drive shaft. The combing wheel 81 which picks the topmost sheet from a stack is coupled to a shaft. A pulley 84 is connected to one end of the shaft. The shaft is journaled in mounting bracket 86. The bracket is pivotally mounted to shaft 78. The mounting bracket 86 is pivotally mounted with respect to drive shaft 78 but is connected to an elongated member 88. The elongated member is connected via a spring loaded mechanical linkage 90 to solenoid 92. Rotary motion to combing wheel 81 is supplied via connecting belt 94. As such, the combing wheel has two types of motion: a rotary motion which is supplied from the drive motor 26 and a pivotal motion activated by the solenoid. The rotary motion allows the combing wheel to pick the topmost sheet from a pile of sheets (not shown) in the support tray 32. A pivotal motion allows the combing wheel to be lowered and raised from the stack when activated by the solenoid. The picker assembly 30 further includes a mounting bracket 31. The mounting bracket is connected to fixed guide rail 96 and functions to support the entire picker assembly. As will be explained subsequently, the fixed guide rail 96 is the registration edge for the support tray 32. As is evident from the description, the picker assembly 30 has two types of motion. When solenoid 92 is activated, the combing wheel 81 through mounting bracket 86, elongated bracket 88, and the mechanical linkage 90 pulls the combing wheel in contact with the topmost sheet of a stack of sheets positioned in support tray 32. The rotary motion transferred to combing wheel 81 through the belts and pulleys connected to drive motor 26 allows the combing wheel to feed a single sheet from the stack into the nip between guide rollers 62 and 64, respectively. It is worthwhile noting that although a specific type of feeding apparatus is shown and described, this should not be construed as a limitation of the scope of the present invention since it is within the skill of the art to substitute other feeding means such as vacuum picker legs, etc. without departing from the scope of the present invention.

Still referring to FIG. 1, support tray 32 includes a plenum 98. The plenum is sealed so that air cannot escape therefrom. Positive pressure is supplied to the plenum chamber through connecting tube 100. When the positive pressure is on, air escapes through holes 102, a plurality of which are fabricated in the bottom 74 of support tray 32. As such, when a stack of sheets (not shown) are placed in support tray 32, the stack flies relative to the bottom of the tray. The support tray 32 is further characterized by side members 96 and 103, respectively. The side members are firmly attached to bottom 74. As was stated previously, side members 96 function as the registration or alignment edge for sheets inserted into the tray. Sheets are prevented from escaping from the tray by back stop means 104. In order to enable the tray to accommodate variable sizes of paper, an adjustable guide 106 is adopted to coact with back stop means 104 and bottom 74. The adjustable guide 106 can be moved in the direction shown by arrow 109 and, therefore, enables various sizes of sheets to be accommodated in the tray. Of course the positioning of the guide member 106 depends on the size of the sheet using fixed guide rail 96 as the reference edge. A hole is fabricated in the bottom 74 of support tray 32 through which the drive roller 108 protrudes. The function of the drive roller is to drive a sheet (not shown) which enters the tray so that it is registered with side edge 96 and the back stop 104. The drive roller 108 is mounted on a shaft which is coupled to a drive motor 109. The drive roller 108 is surrounded by a source of negative pressure or vacuum. In operation, as a sheet enters the tray the drive roller motor is activated which rotates the drive roller 108 and the negative pressure tends to suck the sheet against the roller and create a frictional relationship so that the sheet is driven into registration at the bottom of a stack. The negative pressure into the plenum 144 (FIG. 2) about the drive roller 108 is supplied by vacuum valve 110. Negative vacuum to the vacuum valve is supplied through connecting tube 112. The entry of negative vacuum around the drive wheel is controlled by vacuum solenoid 114. The vacuum solenoid, under the control of an enabling pulse, will periodically activate the vacuum valve 110 so that negative pressure is around the drive roller 108. Similarly, the vacuum solenoid 114 controls the vacuum valve 110 so that periodically the negative vacuum around drive roller 108 is deactivated. In order to control the motor 109, driving drive roller 108 and the vacuum solenoid 114, a tray sensor means 116 which may be similar to sensor 68, previously described, is positioned at the bottom entry section of the tray. In operation, as the leading edge of a sheet (not shown) crosses the sensor, a control signal is generated which enables the feed roll motor to rotate feed roll 108 and vacuum solenoid 114 to create the vacuum about the feed roll. As the trailing edge of the sheet exits sensor means 116, the drive roller 108 is stopped and the vacuum about said roller is deactivated.

In normal operation, a stack of sheets (not shown) is loaded into support tray 32. With the stack of sheets loaded into the tray, the picker assembly 30 automatically adjusts so that the combing wheel 81 is in relative proximity to the topmost sheet on the stack. An enabling pulse is generated which activates pick solenoid 92 and the combing wheel feeds the topmost sheet along output paper path 118 through the nip of feed rollers 62 and 64, respectively. As the sheet exits, its passage is sensed by nip sensor 68. The signal generated from the nip sensor is used to control the lowering and raising of picker assembly 30 onto the stack. The sheet is then fed onto support platen 120. As will be described subsequently in the operational section of this description, the support platen may be aligned relative to the document glass of an electrophotographic copying device or other suitable machine which is used in combination with the present device. After a predetermined period of time, the sheet which was placed on support platen 120 is fed by feed rolls 42 and 62, respectively, along paper path 122 into the tray. As the sheet enters the support tray 32, the leading edge is sensed by tray sensor means 116 and an enabling pulse is generated. The pulse is used to activate drive roller 108 and its surrounding vacuum. As the sheet is registered against fixed guide rail 96 and the back stop of the tray, the trailing edge is sensed and the drive roller and its associated vacuum is deactivated.

Still referring to FIG. 1, in order to control a stack of sheets positioned in tray 32 so that sheets can be fed from the top and stacked under the bottom, the support tray 32 is fitted with a sheet support means 122 and a sheet lift means 124. The support means 122 and the lift means 124 work synchroniously to support the stack while a sheet is inserted thereunder. The support means 122 supports one edge of the stack while a sheet is inserted under the bottom of said stack. After the sheet is inserted in the bin, the support means 122 is removed from supporting the stack while the lift means 124 lifts the stack including the last inserted sheet. The support means is then positioned to support the stack while the lift means is lowered to enable the feeding of another sheet. The support means 122 is an elongated member running the entire width of the support tray 32. The back of the support member is solid while the front has a plurality of teeth 126. The solid portion 128 (see FIG. 2) is inclined with respect to the teeth-portion 126. One end of support means 122 is attached to bracket 130. A pin 132 is rigidly affixed to side member 103 and bracket 130 is pivotally mounted to pin 132. Another pin 134 is fixedly mounted to bracket 130. Support means solenoid 138 (FIGS. 2 and 3) is coupled by mechanical link 140 to this pin. A spring 136 (FIGS. 2 and 3) is used to bias support means 122 to its nonsupport position. In operation when vane solenoid 138 is enabled by a controlled pulse, the solenoid pulls down on mechanical linkage 140 whereby the support member pivots and traces an arc like trajectory with respect to the bottom of the support tray 32 to thereby support a stack (not shown) in the tray. Upon deactivation of the solenoid, the support member under the influence of spring 136 is rotated so as not to be in contact with the stack. Stated another way, when vane solenoid 138 is activated, the support means 122 is rotated into contact with one end of the stack. When the vane solenoid is deactivated the support means is rotated out of contact with the stack.

Likewise, lift means 124 is an elongated member running the width of the support tray 32. The lift member has a substantially rectangular back portion with a plurality of teeth fabricated on the front section. A section of the bottom 74 of the support tray is recessed along a path running the length of the lift means. As a result the top surface 300 of the lift means when in the lowered position is on the same level with the bottom of the support tray 32. Stated another way, the lift means 124 when in the lowered position, mates with the pattern generated in the bottom of the support tray to form a continuous surface. As a result of this construction, when a stack (not shown) located in the tray is supported by the support means 122, a sheet can be inserted at the bottom of the stack without obstruction from the lift mechanism. In order to activate the lift mechanism, a pair of vane solenoids 142 and 143, respectively, are attached through mechanical linkage to the lift mechanism. The vane solenoids are arranged so that one is attached to each end of the elongated lift means. For example, vane solenoid 142 is interconnected through mechanical linkage 141 to one end of the lift means. The enabling signal which controls the lifts solenoids are generated by tray sensor means 116.

Figure 2:
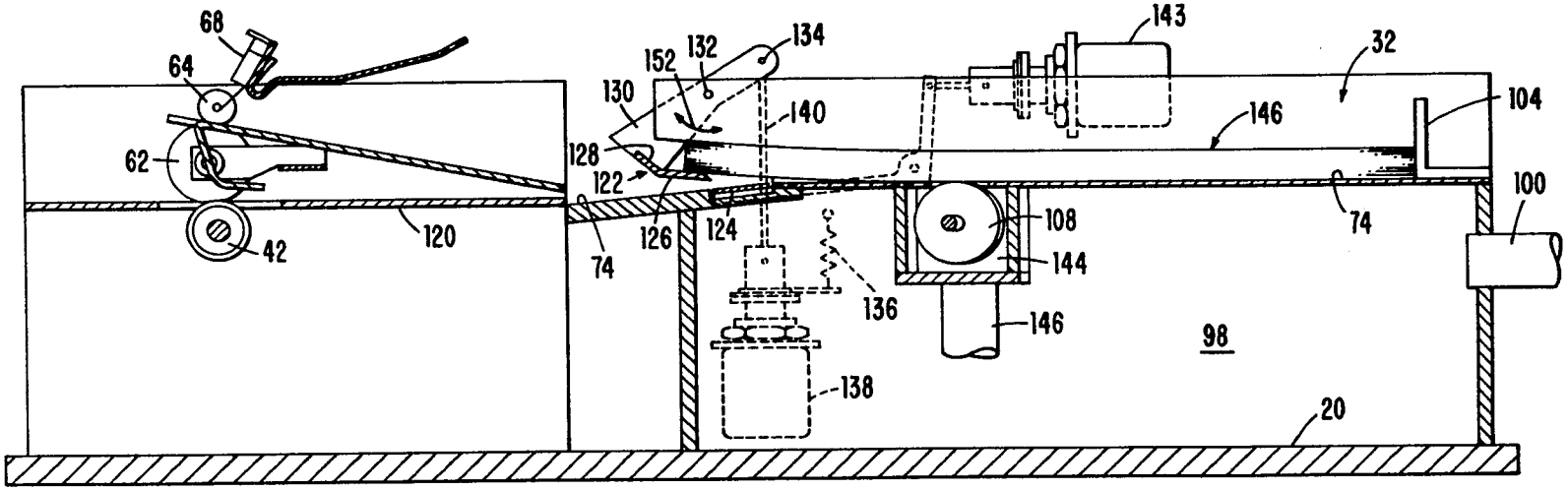
FIG. 2 shows a schematic cross-section of the paper feed apparatus of FIG. 1. The schematic is helpful in understanding the invention.
Figure 3:
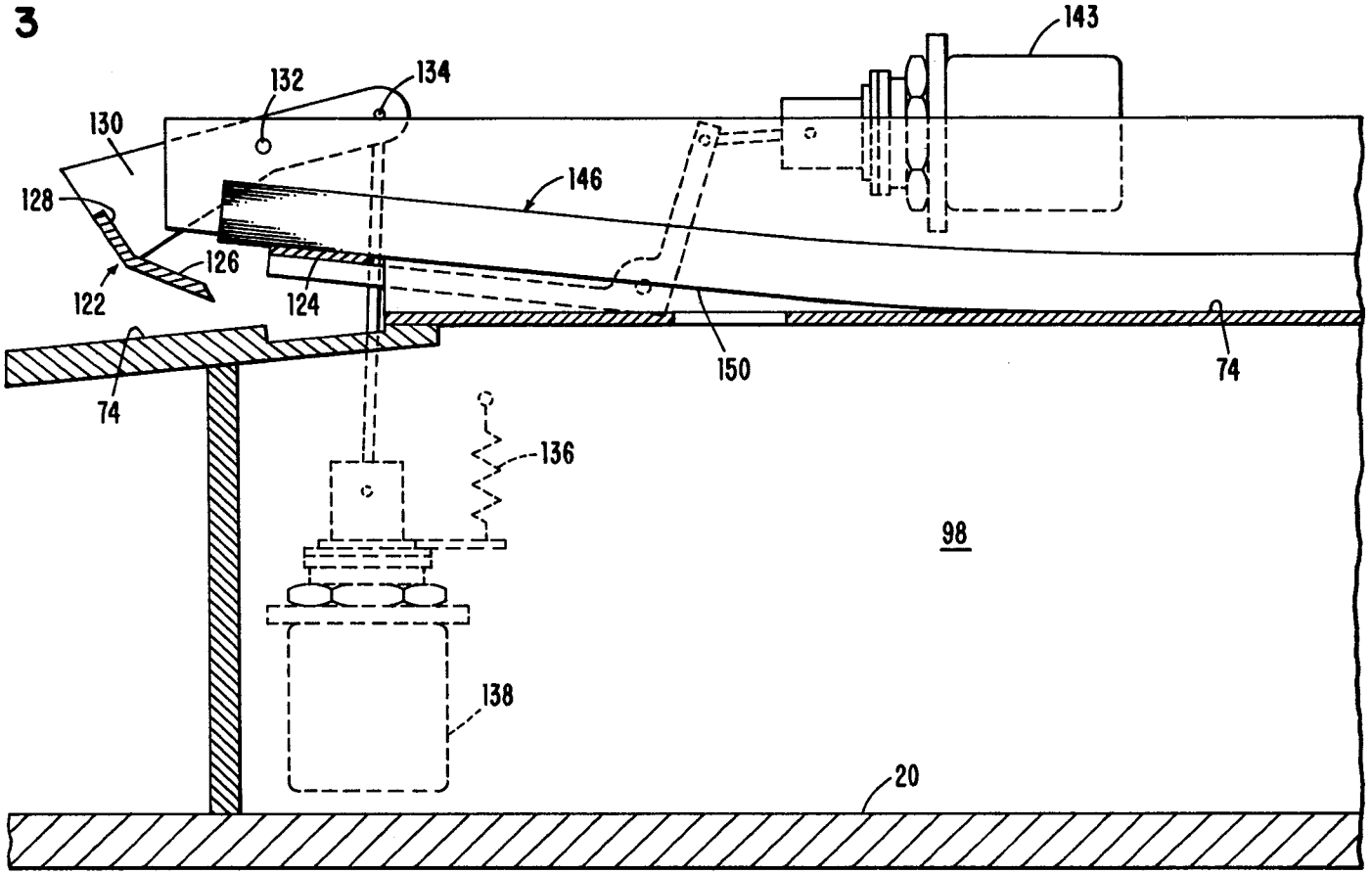
FIG. 3 shows a schematic of a lift mechanism supporting a stack of paper.

Referring now to FIG. 2, a schematic cross section taken across the paper feed device of FIG. 1 is shown. This cross section is helpful in understanding the operation of the device. For ease of explanation, elements in FIG. 2 which are common with previously described elements will be identified with common numerals. In FIG. 2, support tray 32 includes plenum 98 which is supplied with positive pressure from connecting vacuum tube 100. Likewise, the air bearing surface or bottom 74 is fixed onto the plenum. A second plenum 144 is positioned about feed roller 108. As was stated previously, the feed roller 108 drives an inserted sheet into final registration in the tray. Negative pressure is supplied to plenum 144 through connecting tube 146. Lift means 124 mates with bottom surface 74 of the support tray and is controlled by two lift solenoids only one (lift solenoid 143) of which is shown in FIG. 2. The support means comprises a solid back portion 128 inclined to a plurality of teeth sections 126. The support means is connected via the mechanical linkage 140 to support means solenoid 138. In operation, a sheet is fed along the sheet feed direction into the nip of feed rollers 42 and 62, respectively. During the period when the sheet traverses the feed path, the positive pressure, which is supplied to plenum 98, escapes through air bearing 74 and flies the stack 146 relative to the bottom of the support means or tray. Simultaneously, the front edge of the stack is supported by support means 122 under the influence of the support means solenoid 138. The sheet 150 is fed into registration in the tray by feed roller 108. As is evident in FIG. 3, the trailing edge of sheet 150 now rests under the support means 122. By deactivating the support means solenoid, the support means is pivoted out of contact with the stack along the direction shown by arrow 152 (FIG. 2). FIG. 3 shows the position of support means 122 when it is rotated from stack 146. As the support means is pivoted from the stack, lift means 124 is activated by stack lift solenoid 142 to raise stack 146 and merge the newly inserted bottom most sheet 150 with the stack. The sequence is completed by lowering lift means 124 to its normal position shown in FIG. 2 and rotating support means 122 to again support the stack while another sheet is fed under the bottom. Of course, the support means may be pivoted into supporting contact with the stack prior to lowering the lift means. Alternately, the sequence may be performed simultaneously; that is, the lift means is lowered while the support means is rotated into contact with the stack. Also, the support means can be positioned to contact the stack prior to lowering the lift means.

Figure 4:
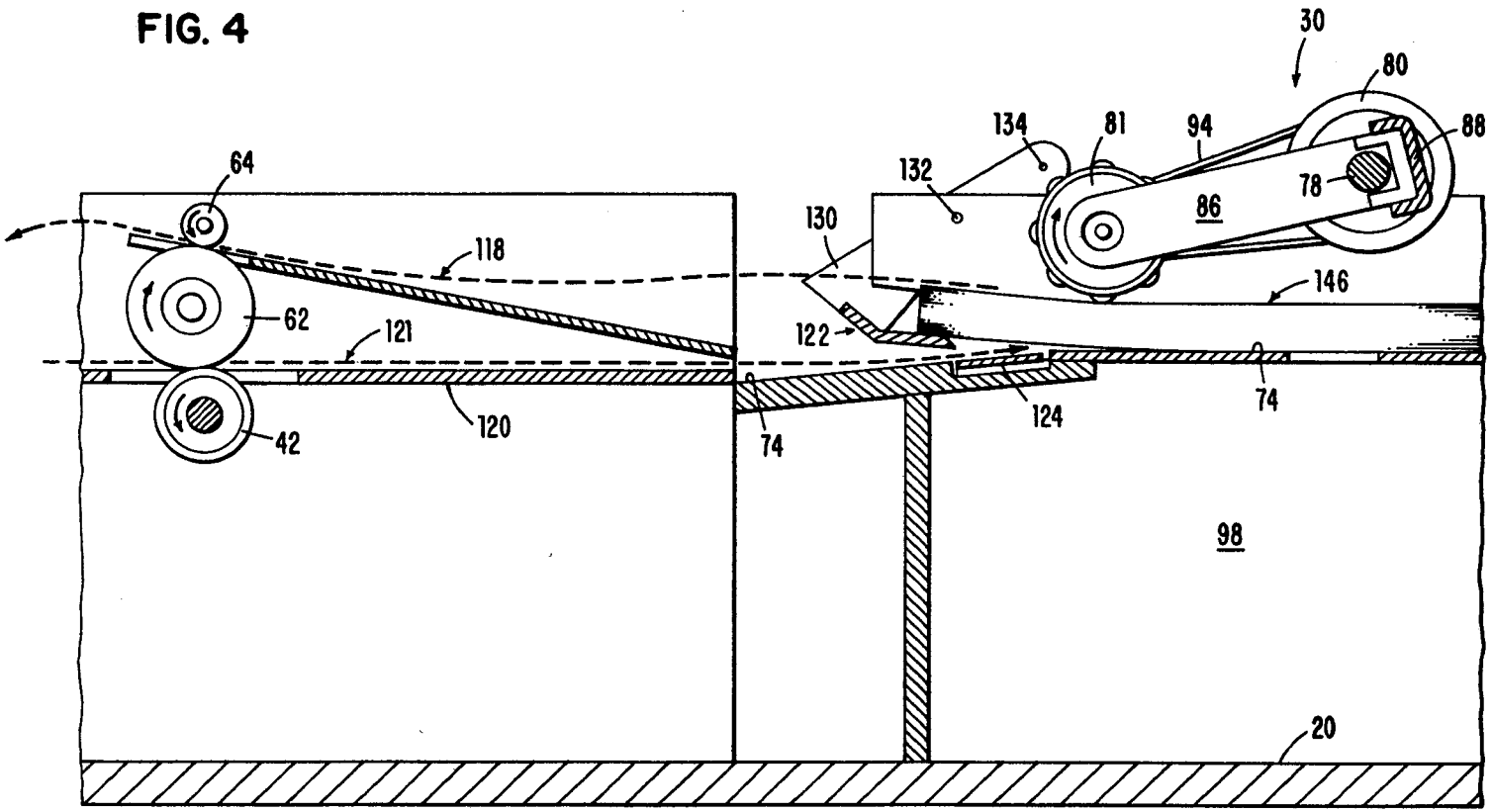
FIG. 4 is a schematic showing a stack of sheets in a support tray with a means for feeding the sheet from the top. The figure is a conceptual showing of the invention.

While the above described FIGS. 2 and 3 explain the stacking operation whereby a sheet is fed under the stack, FIG. 4 discloses the operation whereby a sheet is fed from the top of the stack. The showing in FIG. 4 envisions an arrangement whereby the sheet feeding device coacts with an electrophotographic copier (not shown). The topmost sheet from the sheet stack is fed by combing wheel 81 along out path 118 onto the document platen (not shown). After copying the sheet is fed along path 121 under the stack. As previously described, support means 122 and lift means 124 coact to support and lift the stack during the period when a sheet is inserted.

Figure 5:
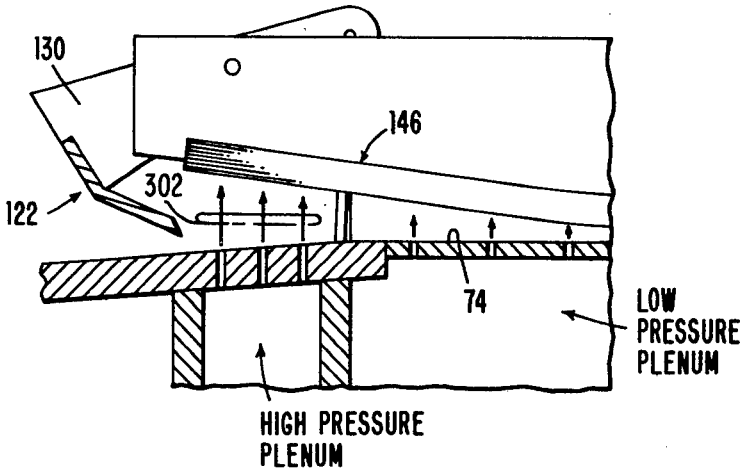
FIG. 5 shows an alternate method for lifting one edge of the stack so that an incoming sheet is inserted thereunder.

Referring now to FIG. 5, an alternative means of lifting the stack is shown schematically. In the alternate embodiment, the stack is supported above the platform of the support tray by the air bearing as was previously described. However, the lifting function is performed by a plurality of air jets 302 which are positioned relative to the support means and across the width of the tray.

Figure 6:
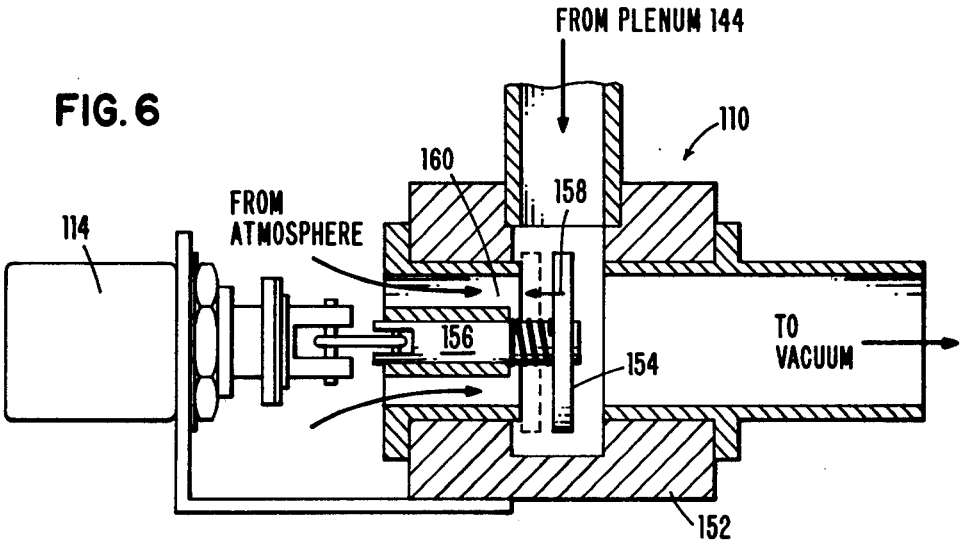
FIG. 6 shows a vacuum valve suitable for use with the sheet feeding device of FIG. 1.

Referring now to FIG. 6, the detail of vacuum valve 110 and vacuum solenoid 114 is shown. As was stated previously, the vacuum solenoid and the vacuum valve controls the vacuum which is supplied about drive roller 108 so that a sheet of paper can be driven in proper registration in support tray 32. The vacuum pulls a sheet onto the drive roller 108 (FIG. 1) to create friction therebetween. The vacuum valve 110 includes a valve housing 152 with a valve closure member 154 seated therein. The valve closure member is connected to shaft 156. The shaft is connected by a link to the vacuum solenoid 114. When the solenoid is activated, the valve closure member is moved in the direction shown by arrow 158. Depending on the position of the valve closure member relative to outlet 160, the vacuum around the feed wheel 108 is either on or off. By way of example, when the valve closure member is positioned in the position shown in the drawing by the solid line, then the vacuum around the drive roller 108 is off. Likewise, when the valve closure member is in the position shown by the broken line, the vacuum around the drive roller 108 is on. The enabling signal to the vacuum solenoid 114 is generated from the tray sensor.

Figure 7:
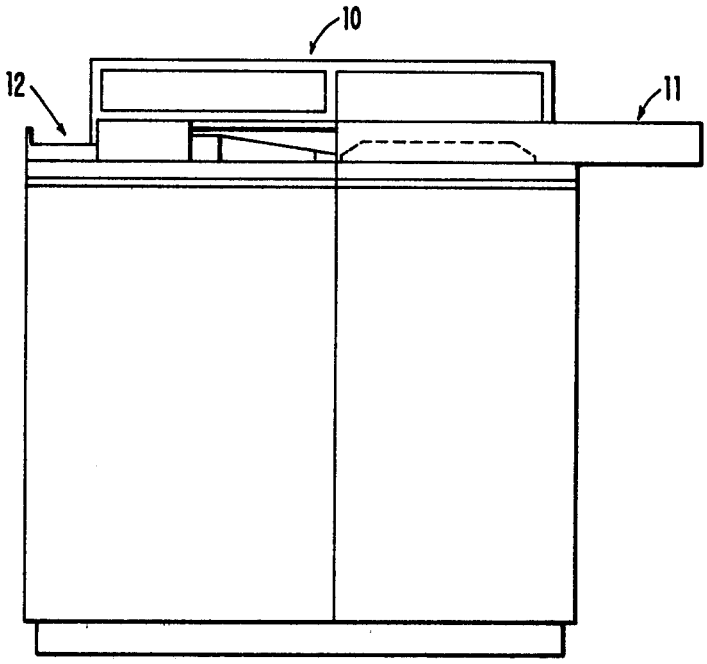
FIG. 7 shows the paper feed device attached to an electrophotographic copier. In this application the paper feed device functions as a recirculating automatic document feed (RADF).

By way of utility example, FIG. 7 shows an alternate configuration whereby the above described paper feed device 11 is connected to an electrophotographic copier 10. The electrophotographic copier 10 which may be the Series III copier/duplicator, Model 10, manufactured by International Business Machines Corporation, includes Recirculating Automatic Document Feed (RADF) 11 of the present invention. As is well known by those of skill in the art, a multiple page original document is placed in RADF 11, and is recirculated a given number of times, for example, 10 times. During each circulation of the original document, one simplex copy is made of each page. These simplex copies are stacked in exit pocket 12. Thus, after ten recirculations, ten collated sets reside in the exit pocket in a single stack awaiting normal separation.

While not pertinent to the present invention, sheet offsetting mechanisms are available for use with exit pocket 12, to physically offset each set from its upper and lower adjacent sets for ease of manual separation.

In an ultimate limitless collation installation, not shown, the copier of FIG. 7 supplies its output copies to a two-module collator, each module having, for example, 20 bins. When the device of FIG. 7 is used with such a two-module collator, the RADF is operated to feed original documents that the copier/collator makes 20 copies of each page of the multi-page original document, and to collate the copies, one to each collator bin of the first module. When the original document has been copied once, 20 copies per page, the first collator module contains 20 collated copy sets. The RADF now begins copying again, that is recirculating and produces 20 more such sets in the second collator module, as the first module is unloaded. Thereafter, the first collator module is used as a second module is unloaded. This procedure continues until the needed limitless number of copy sets are made.

Figure 8:
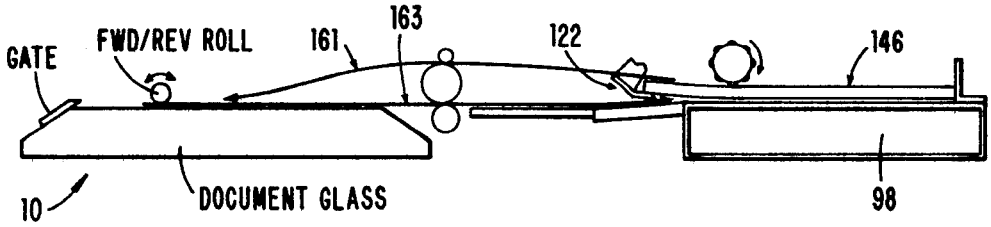
FIG. 8 shows an alternate configuration of the paper feed device connected to an electrophotographic copier.

FIG. 8 shows another configuration wherein the document feed device is connected to the electrophotographic copying device 10. In this configuration, a stack of documents are positioned in the tray of the document feed device. The stack is supported by a hydrostatic air bearing. The leading end of the stack is supported by support means 122. Sheets are fed from the top of the stack by the feed rolls into a pair of upper transport rolls. The upper transport rolls transfer the sheet along paper path 161. The sheet is then fed by forward reverse roll until it is firmly positioned on the document glass against the gate. After copying the information from the sheet, the forward/reverse roll feeds the sheet along return paper path 163. The sheet is then transported by lower transport rolls to be stacked at the bottom of the pile in the tray.

As was stated previously, the paper feed device, according to the present invention, feeds sheets serially from the top of a stack of sheets positioned in the support tray 32 (FIGS. 1, 2 and 3) and then stacks the sheets at the bottom of the pile. In order to achieve this function, support means 122 support one end of the stack while a sheet is inserted under the bottom of the stack. After the sheet is in proper registration in the tray, the support means is rotated out of contact with the stack. A lift means 124 is then activated, moves in a plane perpendicular to the bottom of the support tray and lifts one end of the stack a predetermined distance above the bottom of said tray. As such, the last inserted sheet merges with the stack. The support means is again activated and is rotated into contact with the stack. The lift means is then withdrawn or lowered to its normal position and another sheet is fed onto the bottom of the stack. Simultaneously, with controlling the lift means 124, support means 122, drive roller 108 and the vacuum associated therewith is controlled accordingly.

In order to perform the above enumerated function, a controller is needed to control the various components in the paper feed device. Although a plurality of controllers may be used to effectuate the above described function, in the preferred embodiment of the present invention a MCS 6502 micro computer is used. This micro computer is manufactured by MOS Technology and is commercially available together with programming instructions therefore. It is worthwhile noting that it is within the skill of the art to program the MCS 6502 micro computer. Also, a plurality of different types of programs can be written by those skilled in the art to effectuate the result of the invention. As such, the flow diagram and the program listing described hereinafter should be construed as being illustrative rather than a limitation on the scope of the present invention.

Figure 9:
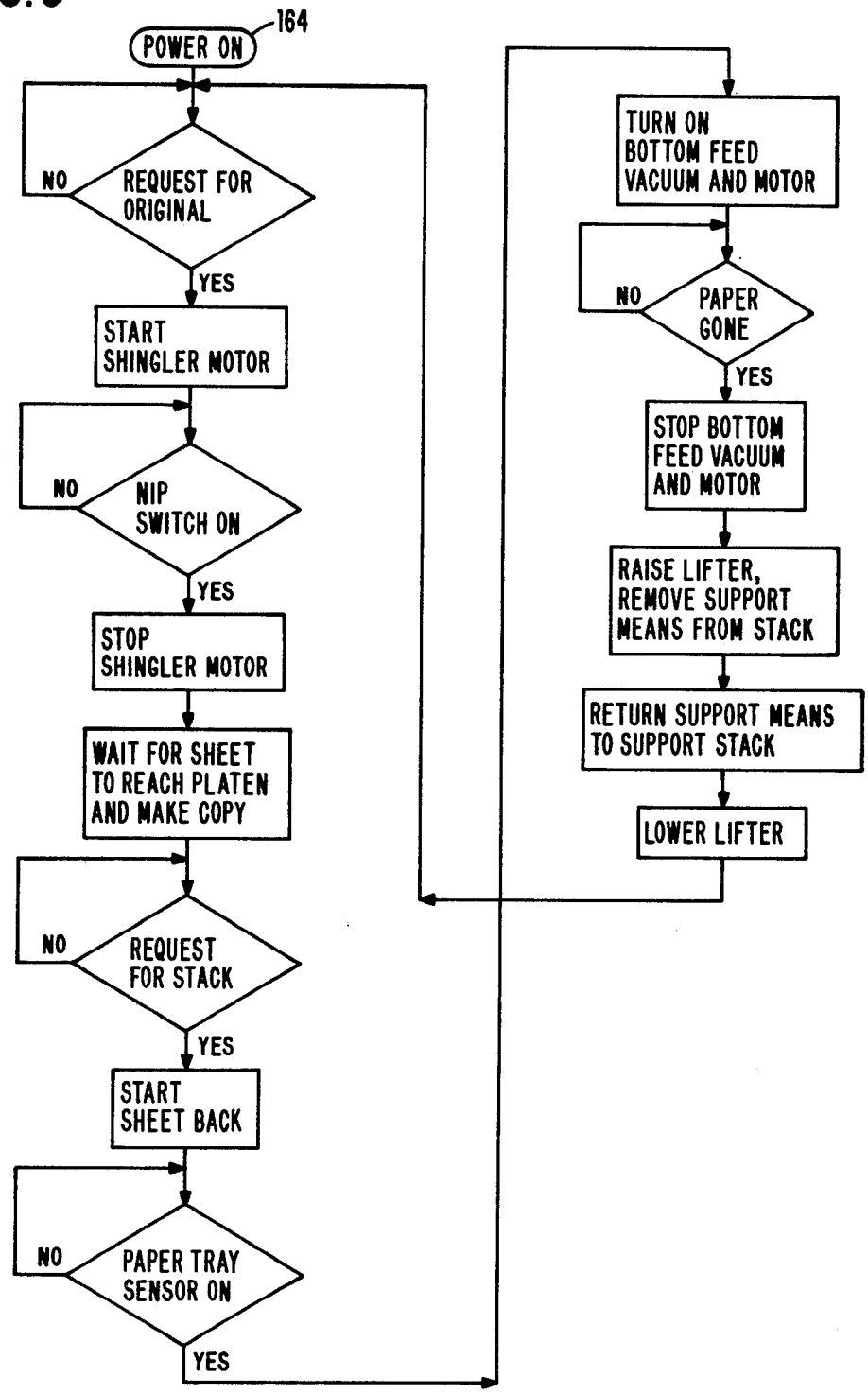
FIG. 9 shows a flowchart of a program used in a controller which controls the paper feed device.

FIG. 9 shows a flowchart which gives an overview of a series of programming steps used in controlling the controller so as to effectuate top feed bottom stacking of the device according to the present invention. The flowchart will be described in descending order beginning at terminal block 164. The program begins at terminal block 164 with an operator turning on the power switch associated with the paper feed device. With the power on, the program looks to see if a request for an original document from the stack is issued. If there is no request, the program goes into a loop. With the request present, a control pulse is generated to start the combing wheel motor 26 (FIG. 1). With the combing wheel motor running, the combing wheel is lowered via solenoid 92 (FIG. 1) and a single sheet of paper is fed from the top of the stack. The program then interrogates the nip switch 68 (FIG. 1) to see if it is on. The nip switch comes on when the paper is present in the paper feed path under said nip switch. If the nip switch is not on, the program goes into a loop and remains in the loop until the switch is on. When the nip switch is on a pulse is outputted therefrom. With the pulse outputted from the nip switch, the program stops the combing wheel motor and raises the combing wheel from the stack. The program then goes into a wait routine. The wait period allows the picked sheet to reach the platen and the electrophotographic apparatus to make one or more copies of the document placed on said platen. If the sheet feeding device was not connected to a copier then the wait routine would allow the sheet to clear the paper path before another sheet is fed. The program then looks to see if another request for stack is being issued by the copier. If no request is issued, the program goes into a loop until there is a request. Then the program starts the feed means and begins to feed the sheet back from the platen towards the bottom of the pile. The program then polls the paper tray sensor 116 to see when it is on. As was described previously, the paper tray sensor 116 is positioned in the path of a paper which is fed back into the tray. As such, the paper tray sensor outputs a pulse when it is covered by the leading edge of a sheet. With the paper tray sensor on, the motor which drives feed roller 108 and the vacuum associated therewith is turned on. The program then looks to see when the paper is gone, that is properly registered within the tray. The registration of the paper in the tray can be determined by polling the bottom tray sensor 116. With the paper in the tray, the feed roll 108 is stopped and the vacuum associated therewith is deactivated. The lifter mechanism 124 is then raised to support the stack. Simultaneously, the support means 122 is removed from supporting the stack. The lift mechanism, in effect, merges the last inserted sheet with the stack. After the merging, the support means is brought back into contact with the stack while the lift mechanism is removed, that is lowered. If it becomes necessary to feed additional sheets from the stack, then the above enumerated steps are repeated. If not, the device is halted.

Figure 10:
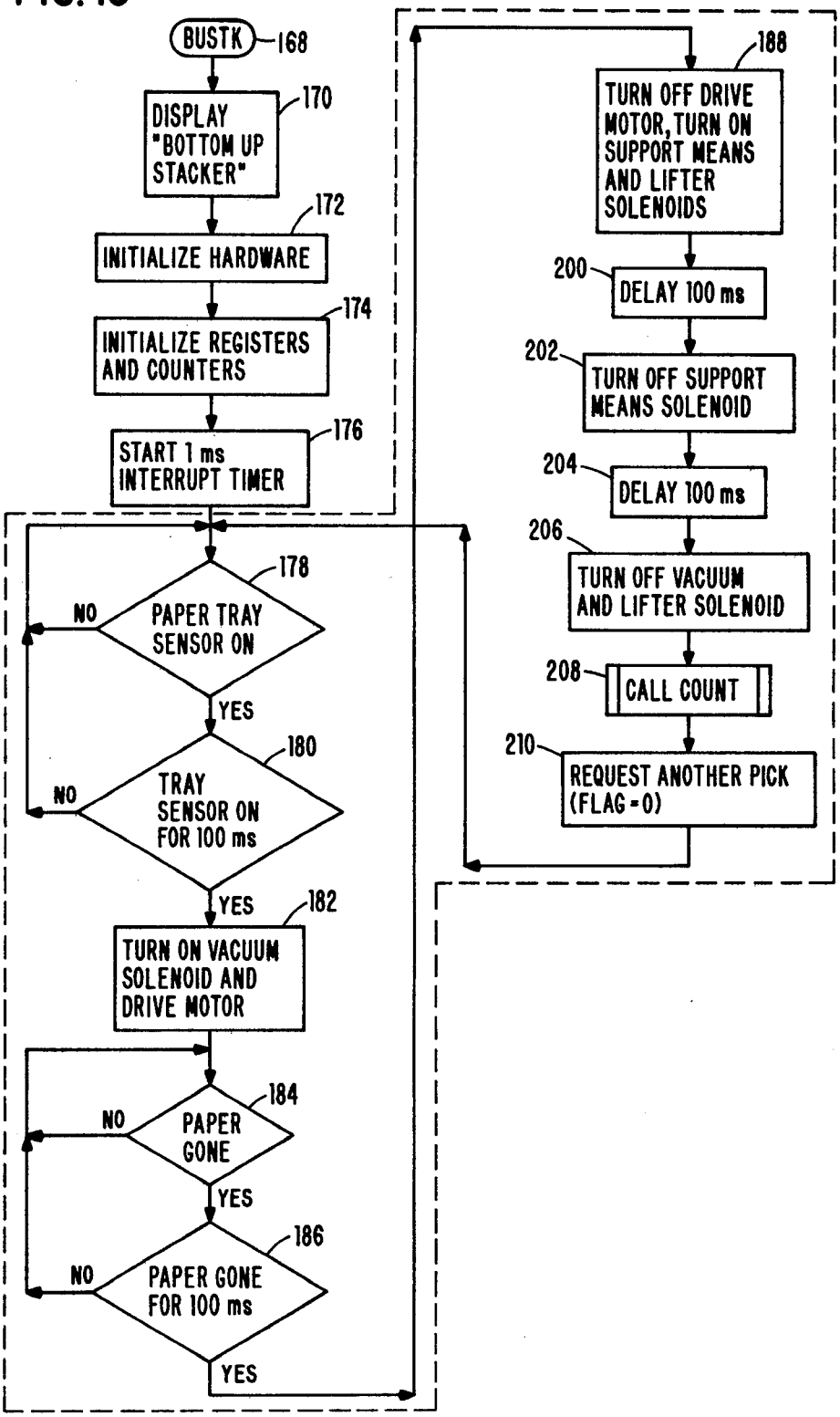
FIG. 10 gives, in more detail, a series of programming steps for the controller.

FIG. 10 gives, in more detail, the flowchart of a control program used with the controller which controls the paper stacking device. The portion of the program which is circled with broken lines forms a loop which controls the lifting mechanism 124, (FIG. 1) the support mechanism 122, the motor which drives feed roller 108 and the vacuum associated therewith. Entry block 168 defines the device to be controlled. The device is bottom-up stacker (BSTK). Although not germane to the understanding of the present invention, process function block 170 generates the term "bottom up stacker" on a display panel. Process function block 172 next initializes all hardware counters, registers, ETC associated with the paper feed device. Next process function block 174 initializes registers and counters associated with the microprocessor. Process function block 176 then starts a one millisecond interrupt timer.

The decisional block 178 checks to see if the paper tray sensor is on. If the sensor is not on, the program goes into a loop and remains in the loop until the sensor comes on. With the sensor on, the decisional block 180 checks to see that is on for at least 100 nanoseconds. At the end of the 100 nanoseconds, process function block 182 turns on the feed roller 108 and the vacuum associated therewith. Decisional block 178 and 180, respectively, allows any electrical transient associated with the paper tray sensor to die out before the drive motor and its vacuum is turned on.

Similarly, decisional blocks 184 and 186, respectively, assure that the sheet of paper is in the tray before the drive motor and its associated vacuum is turned off and the support means 122 (FIG. 1) is rotated from the stack and the lifter mechanism is activated (process function block 188). Process function block 200 then delays any action for 100 ms. At the end of the delayed period, process function block 202 turns off the support means solenoid. This means that the support means is again in supporting contact with the stack. Process function block 204 then delays processing for 100 milloseconds. The lifter solenoid and the vacuum which works in conjunction with feed roll 108 is then turned off by process function block 206.

With the lift solenoid off and the vacuum associated with feed roller 108 off, the program then goes into block 208. Block 208 is a subroutine block. The subroutine is identified as "call count". This subroutine will be discussed subsequently in greater detail. Suffice it to say, at this time, that the call count routine enables a count to be displayed on the display panel of the device as a sheet is stacked in the bottom of the stacker. From the call count routine block 208, the program then steps into block 210. The function performed by block 210 is to set a flag equals 0 if another request for a document is outstanding.

Figure 11:
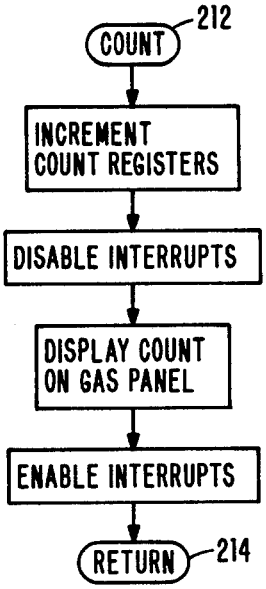
FIG. 11 shows the programming step for the "Call Count Routine."

FIG. 11 shows the programing steps for the "call count" routine. The function to be determined is identified as a count in block 212. The call count routine is performed by incrementing the count registers after a sheet is stacked into the bin. The next step in the routine is to disable all interrupts and display a count on a gas panel. After the count is displayed, the interrupts are again enabled and then the program returns from exit block 214.

Figure 12:
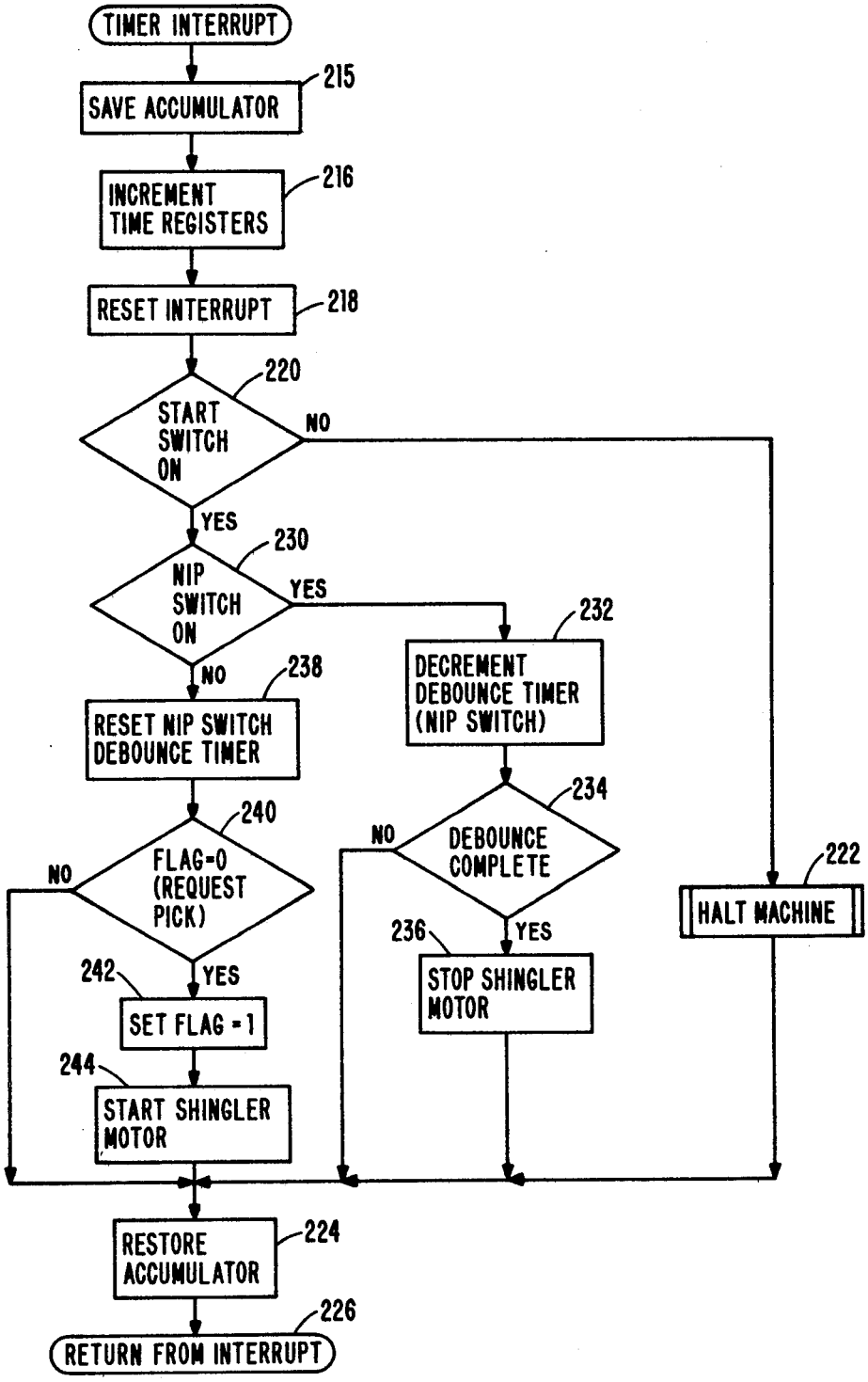
FIG. 12 shows, in detail, programming steps for controlling the shingler motor.

Referring now to FIG. 12, the programming steps used to control the drive motor 26 are shown. The beginning block in the program occurs when a timer interrupt is issued. The interrupt is issued every one millisecond (see block 176 FIG. 10). With the timer interrupt being issued, the following steps occur. The contents of the accumulator are saved (block 215); the time registers are incremented (block 216) in order to keep track of time and the interrupt timer is reset (block 218). The next step in the program is that decisional block 220 interrogates the start switch to see if it is on. If the start switch is not on, then the program branches into a subroutine identified as "Halt" block 222. The function of block 222 is to halt the machine when the start switch is not on. After the machine is halted, the accumulator is restored (block 224) and the program returns from the interrupt routine (block 226).

Figure 13:
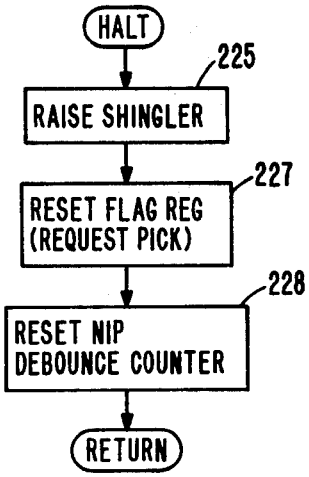
FIG. 13 shows the programming steps for the "Halt" routine.

Referring now to FIG. 13 for the moment, the programming steps for the "halt routine" is shown. Once the halt routine is initiated, the combing wheel 81 (FIG. 1) also called shingler wheel, is raised from the stack (block 225). The flag register is reset if a pick request is not outstanding (block 227). The nip debounce counter is reset (block 228) and then the program returns to the normal program flow.

Referring again to FIG. 12, if the start switch is on (decisional block 220), the next step is to check if the nip switch is on decisional block 230. If the nip switch is on, then the program decrements the debounce timer (block 232). The purpose of the debounce timer is to see that all electrical transient associated with the nip switch dies out before any action relative to the shingler is initiated. Once the debounce is completed, decisional block 234, then the shingler motor is stopped (block 236). The program then restores the contents of the accumulator (block 224) and then returns from the interrupt (block 226). If the nip switch (block 230) is off, the nip switch debounce timer is reset (block 238). In accordance with decisional block 240, if a request is outstanding to pick a sheet then a flag is set equal to 0. With the flag set to equal 0, the program exits from decisional block 240 to restore the accumulator and return from the interrupt. If the flag is set equal to 1, decisional block 242, this signifies that another sheet is needed and the shingler motor is started (decisional block 244).

Figure 14:
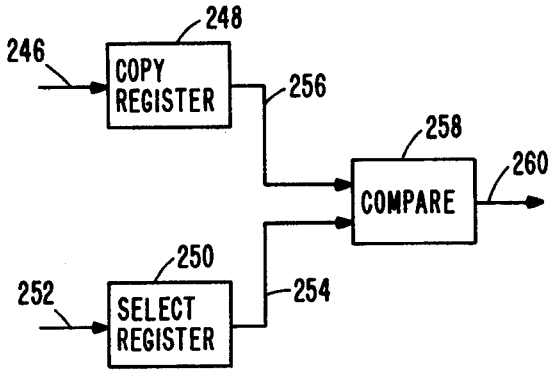
FIG. 14 shows, in block diagram form, a circuit which generates a signal when a sheet is to be fed from the top of the stack.

Referring now to FIG. 14 a controlled circuit, which generates a control signal to inform the microprocessor that a sheet which is positioned on the document glass of the electrophotographic copier should be removed and stacked at the bottom of the stack, is shown. As a sheet is picked from the top of a stack of documents seated in the support tray, a signal is outputted from the nip sensor onto conductor 246. The signal on conductor 246 is stored in copy register 248. The electrophotographic copier is fitted with a select register 250. A select button or switch (not shown) is fitted onto the panel of the copier. The switch is used to set the number of copies to be made from a single original. Generally an operator makes the selection. The number selected by the operator is fed over conductor 252 into the select register. The output from the select register and the output from the copy register are fed over conductors 254 and 256, respectively, into comparator 258. When the counts on conductor 256 and 254 are equal, a control pulse is outputted on conductor 260. The pulse on conductor 260 is utilized by the microprocessor to feed another document from the top of the stack.

It is also desirable to provide a means whereby the copier's control apparatus will know when a stack of original document sheets have been completely circulated and copied and that the next sheet to be copied is the return of the first sheet of the original document sent to be again copied. As is well known to those of skill in the art, one means, of course, would be for the operator to simply count the original document sheets and to provide this number as an input to the copier. The RADF would then feed document sheets and count them to define copy sets. U.S. Pat. No. 3,499,710 incorporated herein by reference, teaches another means, such as a metal-like sheet which comprises the last sheet of a document stack. This metal sheet is sensed as an indication of the completion of the copying of the original document set. A copy of this metal sheet can be made to act as a separator sheet where all copy sheets are stacked in one output copy tray. U.S. Pat. No. 3,565,420 incorporated herein by reference, teaches the use of a movable bale or separator bar which separates the returned original sheets of a set, after copying, from those sheets yet to be copied. At the beginning of copying, this rod is on a first side of the original document set. As copying proceeds, the bar works its way through the set to the other side, thus indicating completion of one recirculation of the original document set. The bar then resets to the first side of the set. U.S. Pat. No. 4,076,408 incorporated herein by reference, is similar in that it teaches the use of a pivoted separator member or finger which extends into the supply hopper or tray for the original document set. This finger operates to separate the sheets into those which have been copied and those which remain to be copied. When this finger reaches a side of the set toward which it incrementally steps one sheet at a time, it swings through a greater than 180° arc to again sit on the other side of the set, thus indicating completion of one recirculation of the original document set.

FIGS. 15A, 15B, 16, 17 and 18 give the program listing for the controller which controls the sheet feeding device according to the teaching of the present invention. It is worthwhile noting that it is within the skill of the art to generate a plurality of programs which would operate the controller so as to enable the paper feed mechanism to pick the top most sheet of paper from a stacked position in the support tray and feed said sheet onto the bottom of the tray. As such, the listing is exemplary and should not be construed as a limitation in the scope of the present invention. The listing is easily interpreted by one skilled in the art and, therefore, will not be described in detail. Each column in the listings is identified by a column heading. From left to right, the first column is the instruction location (INST LOCN). The second column is the operation code (OP CD). The third column is the operand column. The fourth column is the statement number (STMT NO). The fifth column is the label column. The label column allows the programmer to give a name to the operation. The sixth column is the operation column (OP). The operations recorded in the operation column are standard set available with the instruction manual of the particular microcomputer. The seventh column is the address format column (T). This column gives the assembler instruction as to the form of address. The eighth column is the OPERAND column and the ninth column is the comments column.

Still referring to FIGS. 15A, 15B, 16, 17 and 18, columns 6 through 9 are the source code which is written by the programmer with the aid of the instruction set associated with the above identified microcomputer. Columns 1 through 5 are the object code which is generated by the assembler and is used by the microcomputer. FIGS. 15A and 15B are associated with the flowchart of FIG. 9. The FIGS. are identified as list program bottom up stacker (LISTP "BUSTK"). The program comprises 87 statement numbers. Similarly, FIG. 16 is called "List Halt" (LST HALT). This is a program listing for the halt routine of FIG. 13.

Likewise, FIG. 17 is identified as list program count (LISTP "COUNT"). This is the program listing for the count routine of FIG. 11.

FIG. 18 gives the program listing for the interrupt routine and its association with FIG. 12.

By way of example, in FIG. 18 statement numbers 22 through 40 will drop the shingler onto the topmost sheet in the stack, wait for 48 milliseconds (MS) to sense if the sheet is present at the nip switch and then raise the shingler from the stack.

FIGS. 15A and 15B statement numbers 35 through 53 detect paper at the tray sensor and after 100 milliseconds will turn on the drive motor for the drive roller and turn on the vacuum solenoid to control the vacuum associated with said drive roller.

Statement numbers 54 through 79 detect when a sheet is completely registered within the tray and will do the following: turn off drive motor, turn on vane solenoid, turn on lifter solenoid, delay 100 milliseconds (MS) then turn off vane solenoid, delay 100 milliseconds, turn off vacuum solenoid, turn off lift solenoid.

OPERATION

In operation, a stack of documents are placed in support tray 32. With the vacuum on an air bearing is created between the stack and the bottom 74 (FIG. 1) of the support tray. With drive motor 26 activated, the combing wheel 81 rotates and is ready to feed the topmost sheet from the stack. Solenoid 92 is activated which pulls combing wheel 81 onto the topmost sheet and the sheet is fed out by rollers 62 and 64, respectively, along the paper path 118. As the leading edge of the sheet is sensed by nip sensor 68, a control signal is generated. The signal is utilized by solenoid 92 to raise the combing wheel 81 from the stack. The sheet is then ejected onto platen 120. When the sheet feeding apparatus is used in conjunction with an electrophotographic apparatus, the sheet is ejected onto the document platen of the apparatus. The sheet remains on the platen for a predetermined period of time. For example, until a predetermined number of copies are generated therefrom.

In accordance with FIG. 14, when the number of copies are made a control signal is generated on terminal 260. The signal is utilized by the controller which activates the forward/reverse roll shown in FIG. 8 to feed the sheets into the nip between roller 42 and 62, respectively. As the sheet of paper travels along return paper path 121, driven by rollers 42 and 62, respectively, the leading edge of the paper is sensed by tray sensor means 116. A control signal is outputted from tray sensor means 116. The signal activates the motor which drives feed roll 108. The signal also activates vacuum solenoid 114 so that negative pressure is maintained about drive roller 108. The negative pressure pulls the incoming sheet onto drive roller 108 and since drive roller 108 is positioned at a slant relative to registration side 96, the paper is driven into registration in the tray.

During the period when the sheet is driven into the tray, the stack in the tray is supported along one edge by support means 122. Likewise, lift means 124 is in it lowered position. The trailing edge of the sheet is sensed by tray sensor means 116 which outputs a control signal. The signal is used to deactivate the vacuum around drive roller 108 and to bring drive roller 108 to a stop. The signal generated from the trailing edge of the sheet is used to rotate lift means 122 out of contact with the stack. Likewise, the signal is used to activate lift means 124 to lift the stack and, as a result, merge the last inserted sheet with the stack. After a predetermined time, the lift mechanism 124 is lowered and the support means 122 is rotated to support the stack. As such, the device in operation feeds a single sheet from the top of the stack and stack the sheet at the bottom of the pile. The feeding and stacking operation can be done simultaneously to improve system throughout.

While the invention has been particularly shown and described with reference to preferred embodiments thereof, it will be understood by those skilled in the art that various changes in form and details may be made therein without departing from the spirit and scope of the invention:

What is claimed is:

1. Apparatus for bottom stacking sheets in a bin comprising in combination:

an air bearing means operable for elevating the sheets in the bin so that said sheets fly relative to the floor of the bin:

means disposed at an entrance of said bin, said means being operable to lift and to support the sheets so that a space is being generated between the floor of the bin and the sheets; and means for feeding incoming sheets into the space generated between the elevated sheets and the floor of the bin so that damage to the incoming sheets, due to frictional drag and/or incoming sheets crashing into the edge of the stacked sheets, is minimized.

2. The apparatus as claimed in claim 1 wherein the air bearing means includes:

an enclosure having a bottom surface with integrally molded side walls extending upwardly from said bottom surface;

a platen having a plurality of holes therein integrally seated on said sidewalls to form a plenum; and vacuum means for supplying pressure to said plenum.

3. The apparatus claimed in claim 2 wherein the vacuum means include a:

vacuum pump; and a length of hose interconnecting said pump to the plenum.

4. The apparatus as claimed in claim 1 wherein the mens for feeding sheets into the space includes:

a back-up roller;

a friction drive roller positioned relative to said back-up roller to define a gap therebetween;

first means for driving the friction drive roller so as to transport a sheet;

second drive means positioned downstream from the back-up roller and friction roller said second drive means being operable to drive a sheet to a final position within said bin; and second means for driving the second drive means.

5. The apparatus as claimed in claim 4 wherein the second drive means include:

a drive roller;

a source of negative pressure positioned about the roller, said source of negative pressure being operable to create friction between the drive roller and the incoming sheet.

6. Apparatus for stacking sheets comprising in combination:

a platen for supporting a stack of said sheets;

an air bearing associated with said platen and operable to raise the stack above the floor of said platen;

first means for lifting the stack along one edge to create a space between the stack and platen;

second means for supporting the stack along said edge; and drive means associated with the platen and operable to drive an inserted sheet so that said sheet is positioned at the bottom of the stack.

7. The apparatus as is claimed in claim 6 further including force means associated with the drive mens and operable to create driving friction between the inserted sheet and the drive means.

8. A recirculating document feed, for feeding a document to the copy platen of an electrophotographic copier so that the document is viewed and a copy is generated comprising:

a bin for supporting a stack of the documents;

a means for elevating the stack above the floor of the bin;

a first means for feeding a document from the top of the stack onto the copy platen;

a second means for feeding the document from the platen;

means for selectively supporting one end of the stack to define an entrance zone for a copy sheet to be inserted;

means for feeding the copy sheet through the entrance zone and under the elevated stack; and means for selectively lifting the stack to merge the copy sheet with the stack.

9. The apparatus as is claimed in claim 8 wherein the elevating means is an air bearing.

10. An automatic document feed, for use with a copier having a document glass on which an original document is placed for copying, comprising:

a support bin for supporting an original stack of documents for copying;

an air bearing for elevating the stack above the floor of the bin;

means for feeding the documents serially from the top of the stack onto the document glass;

means for feeding the documents serially from the document glass onto the bottom of the stack; and means for raising one end of the stack to generate an opening which allows an incoming document to be bottom stacked free of collision with the elevated stack.

11. The apparatus as claimed in claim 10 wherein the raising means include:

an elongated member pivotally mounted to be in supporting contact selectively with at least one end of the stack;

actuator means connected to the elongated member; said actuator means being operable to pivot the elongated member; and lift means associated with said bin and cooperating with the elongated member to support said stack when the elongated member is not in supporting contact with the stack.

12. The apparatus claimed in claim 11 wherein the lift means include an elongated member and an actuator means connected to said elongated member.

13. The apparatus as claimed in claim 12 further including a control means operable to generate a plurality of control signals for activating the actuators at predetermined intervals.

14. The apparatus as claimed in claim 12 wherein the actuator means include a solenoid.

15. An automatic recirculating document feed for use with an electrophotographic copier having a transparent copy platen for supporting an original document, comprising:

a bin for supporting a stack of documents;

an air bearing associated with the bin and operable to fly the stack above the floor of the bin;

a separator for separating a document in seriatim from the top of the stack;

a first feed means for feeding the single document onto the platen whereat an image of the document is being copied;

a second feed means for feeding the document into the bin after the completion of the copying;

a support means for selectively supporting one end of the stack and creating a space during the intervals when the sheet is being fed into the bin; and means for lifting a newly inserted sheet at the end of the insertion intervals to merge a newly inserted sheet with the stack.

16. The apparatus of claim 15 wherein the means for lifting the newly inserted sheets includes air jets.

17. Method for operating a recirculating document feed comprising the following steps:

1. flying a stack of documents above the bottom of a supporting bin;
2. separating a single document from the top of the document stack;
3. feeding the single document onto a copying platen;
4. feeding the single document from the copy platen after copying;
5. creating space between the stack and the bottom of the supporting bin;
6. stacking the document in said space;
7. performing steps 2 and 5 until the documents are all copied.

18. A recirculating document feed for use with an electrophotographic copier comprising in combination:

a bin for supporting a stack of documents;

an air bearing associated with the bin and operable to fly the stack relative to said bin;

pivotal support means operable to support one end of the stack to create a space;

a separating means for separating a single document from the top of said stack;

means for receiving the single document and feeding said document along a predetermined path onto the copying platen of said electrophotographic copier;

first means positioned within the predetermined path and operable to sense the position of the single document and to activate the separating means accordingly;

second means associated with said copier and operable to generate a completion signal at the end of a copying cycle;

means for utilizing the completion signal and to feed the document from said platen along a second feed path;

third means positioned within the second feed path, operable to generate a control signal indicating the position of the document along said second feed path;

means for receiving the control signal and for feeding the document into the space at the bottom of the stack.

19. A document handling apparatus comprising:

a bin for supporting a stack of sheets;

a feed means associated with said bin and operable to feed a sheet into said bin;

an air bearing associated with said bin and operable to fly the document above the floor of said bin;

a support means connected to the bin and operable to support one end of the stack at a predetermined height; said height being slightly above the flying height of said stack; and an elevating means associated with said bin and operable to periodically lift a newly inserted sheet to merge said sheet with the stack.

20. An apparatus for bottom stacking articles comprising in combination:

a first support means for supporting a stack;

a pressure means for creating an air cushion to fly the stack relative to the first support means;

a second supporting means for supporting one end of the stack to create a space in which a sheet is being inserted under said stack;

a lift means for periodically lifting the stack to merge the inserted sheet with said stack; and control mens for enabling the support means and the lift means.

21. Sheet feeding device for use with an electrophotographic copier or the like comprising in combination:

a tray for supporting a stack of sheets;

means for feeding the topmost sheet from said stack;

air bearing means for flying the stack relative to the tray;

movable support means for supporting one end of the stack so that a space is being generated in which a sheet is being inserted thereunder;

means for feeding the sheet under the bottom of said stack; and control means for activating the movable support means.

22. A method for handling articles comprising the following steps:

flying a stack of articles relative to a support surface;

feeding articles in seriatim from the top of said stack;

elevating one end of said stack to form a space between said stack and the support surface; and inserting articles under the stack.

* * * * *